US006250607B1

(12) United States Patent
Strom

(10) Patent No.: US 6,250,607 B1
(45) Date of Patent: Jun. 26, 2001

(54) SELF TAILING POWER WINCH DRIVE

(76) Inventor: William Strom, Hasler Witikoner Strasse 95 A, 8032 Zurich (CH)

( * ) Notice: Subject to any disclaimer, the term of this patent is extended or adjusted under 35 U.S.C. 154(b) by 0 days.

(21) Appl. No.: 09/284,148

(22) PCT Filed: Oct. 7, 1997

(86) PCT No.: PCT/GB97/02737

§ 371 Date: Aug. 23, 1999

§ 102(e) Date: Aug. 23, 1999

(87) PCT Pub. No.: WO98/15488

PCT Pub. Date: Apr. 16, 1998

(30) Foreign Application Priority Data

Oct. 7, 1996 (GB) ..... 9620883

(51) Int. Cl.[7] ..... B66D 1/12

(52) U.S. Cl. ..... 254/362; 254/342; 254/371

(58) Field of Search ..... 254/342, 344, 254/371, 362

(56) References Cited

U.S. PATENT DOCUMENTS

| | | | | |
|---|---|---|---|---|
| 3,985,340 | * | 10/1976 | Guangorena | 254/344 |
| 4,225,118 | * | 9/1980 | Ottemann | 254/376 |
| 4,230,306 | * | 10/1980 | Porter | 254/371 |
| 5,048,799 | * | 9/1991 | Aronowitsch et al. | 254/344 |
| 5,386,970 | | 2/1995 | Trant . | |
| 5,863,028 | * | 1/1999 | Dunsmore | 254/362 |
| 5,996,971 | * | 12/1999 | Crouse | 254/362 |

FOREIGN PATENT DOCUMENTS

| | | |
|---|---|---|
| 0280527 | 8/1988 | (EP) . |
| WO 94/03390 | 2/1994 | (WO) . |

OTHER PUBLICATIONS

Foreign Search Report, British Patent Office.

* cited by examiner

*Primary Examiner*—Katherine A. Matecki
(74) *Attorney, Agent, or Firm*—Levisohn, Lerner, Berger & Langsam

(57) ABSTRACT

A winch drive comprising a portable power tool having a bit (4) shaped to fit the drive socket (11) at the top of a winch (12). The power tool includes a self-tailing device (14) and is preferably battery driven.

12 Claims, 2 Drawing Sheets

SELF TAILING POWER WINCH DRIVE

BACKGROUND OF THE INVENTION

1. Field of the Invention

The present invention relates to a winch drive, particularly for a boat or yacht.

2. Description of Related Art

Winches are commonly used on yachts or other boats for tensioning or pulling running rigg, usually a line wound around the drum of the winch. The winch is normally rotated manually, and a standard shaped socket is provided in the top of the winch into which the correspondingly shaped end of a handle is inserted. Rotation of the handle rotates the winch and tensions the line. Manually rotating the winch can be difficult work, particularly under certain conditions, eg with heavy load and/or in bad weather.

It is known to power some forms of winch by means of an electric motor situated below deck immediately under the winch. Such a motor takes up valuable under-deck space, and can be difficult to access for servicing.

SUMMARY OF THE INVENTION

An object of this invention is to provide a winch drive, which is simple to operate and does not occupy under-deck space.

The invention provides a winch drive as claimed in claim 1.

Although the shaped bit may be retractable, it is preferably integral with the power tool.

Preferably, the power tool is battery driven, and the batteries are rechargeable. The batteries may be accommodated within a handle of the power tool or in a separate detachable battery housing.

BRIEF DESCRIPTION OF THE DRAWINGS

Embodiments of the invention will now be described with reference to the accompanying drawings, wherein.

DETAILED DESCRIPTION OF THE PREFERRED EMBODIMENTS

Figure 1:
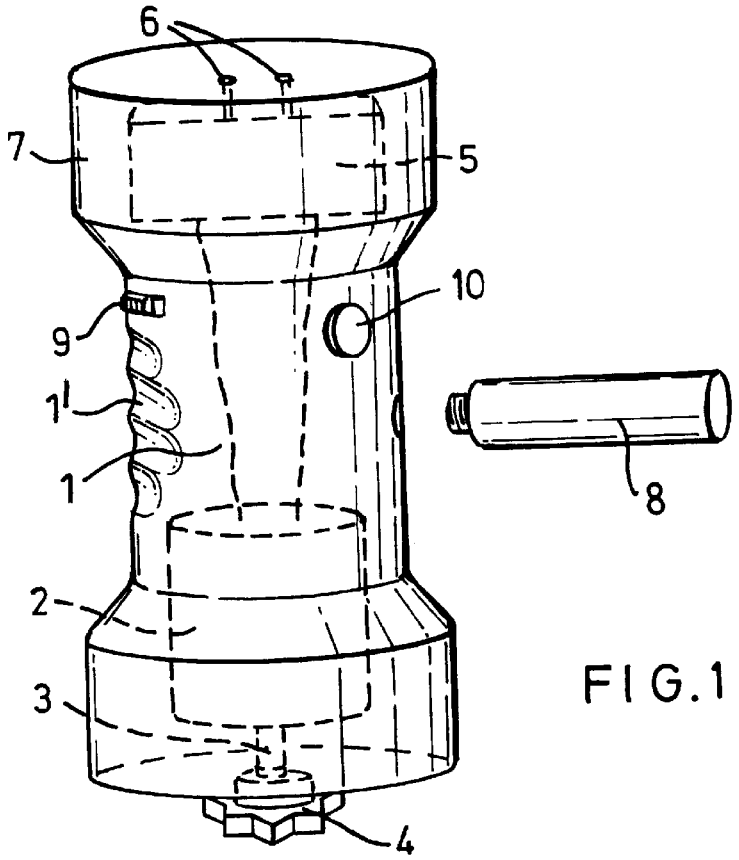
FIG. 1 is a perspective view of a first embodiment of a winch drive in accordance with the invention but not showing the self-tailing device.

In FIG. 1 a winch power drive comprises a body 1 housing an electric motor 2 drivingly connected via a shaft 3 to a shaped bit 4.

The body 1 also houses one or more batteries 5, which are preferably rechargeable via a connection terminal 6. The portion 7 of the body 1 housing the battery 5 may be detachable for ease of recharging. The body 1 may be provided with finger-shaped recesses 1' to facilitate gripping by the operator.

The winch drive has a handle 8, which may be detachable, to prevent rotation of the body 1 while the shaped bit 4 is driven by the electric motor 2.

The body 1 also has a forward and reverse switch 9 as well as a high/low speed control button 10.

The self-tailing device is described with reference to FIG. 5.

Figure 2:
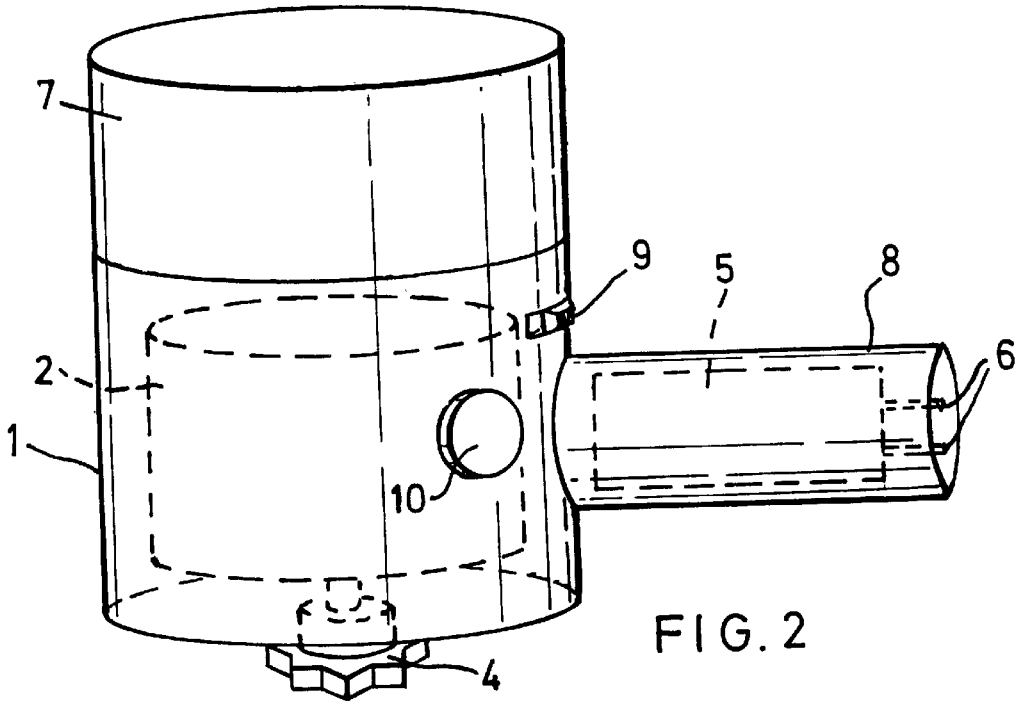
FIG. 2 is a perspective view of a second embodiment of a winch drive in accordance with the invention but not showing the self-tailing device.

The winch drive in FIG. 2 is similar to that shown in FIG. 1, but has a different shape. As shown in FIGS. 1 and 2, the battery or batteries 5 may be contained either in a detachable battery housing 7 or in the handle 8.

Figure 3:
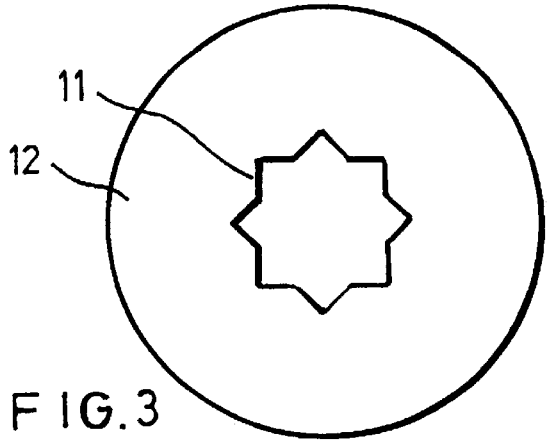
FIG. 3 is a plan view of a winch showing the standard socket for engagement by the shaped end of a winch handle, FIGS. 4A, B and C are underside views of shaped bits for the power drives of FIGS. 1 and 2.
Figure 4A:
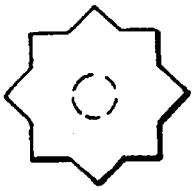
Figure 4B:
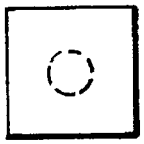
Figure 4C:
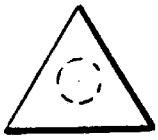

The bit 4 of the winch drive is shaped to engage the standard socket at the top of a winch 12, as shown in FIG. 3. The bit 4 may have the shape as shown in FIG. 4A, 4B or 4C to fit snugly into the socket 11.

Figure 5:
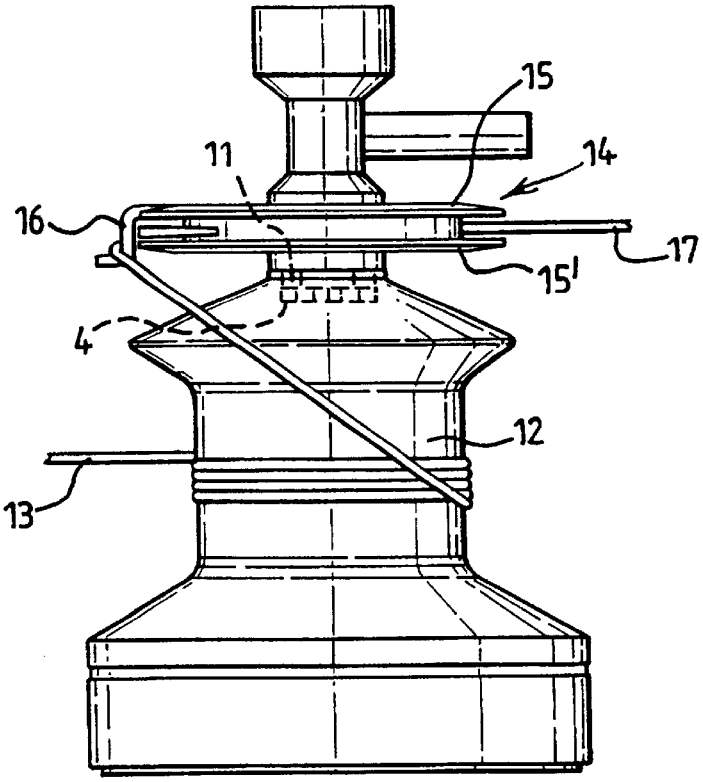
FIG. 5 is a side view of the winch drive of FIG. 1 and showing the self-tailing device.

In accordance with the invention, and as shown in FIG. 5, the winch drive has a self-tailing device 14. This comprises two spaced, annular-shaped discs 15, 15', one of which (here 15') is resiliently movable away from the other disc against the bias of a spring (not shown). The self-tailing device 14 also has a line guide 16.

In use the winch drive is placed on top of the winch so that the bit 4 engages the socket 11 as shown in FIG. 5. The line 13 is wound around the winch 12 and the end 17 of the line is wound around the line guide 16 and drawn between the discs 15, 15' against the bias of the spring (not shown). Thus, the end 17 of the line 13 is firmly held by the self-tailing device 14 to free both hands for operation of the winch drive.

The operator holds the body 1 of the winch drive and the handle securely and switches on the electric motor to drive the winch to tension the rope 13 to the required degree.

The winch can be driven at different speeds or torque by operation of the speed and/or torque control button 10, and also by operation of the forward and reverse switch 9. The standard construction of a boat winch 12 is such that when the socket 11 is rotated in one direction the winch rotates at one speed, whereas when the socket is rotated in the opposite direction the winch rotates in the same direction as previously, but at a different speed.

When the line is to be released, the end 17 is merely pulled out from between the discs 15, 15' and unwound from the winch 12.

The self-tailing device need not be as shown in FIG. 5 but may be adapted from any standard self-tailing device normally applied to winches.

Although the winch drive shown in the drawings is battery driven, it could, for example, be driven by a wind-up clockwork motor directly, or by a clockwork motor via an electric generator.

What is claimed is:

1. A portable powered winch drive attachable to a winch comprising:

a main housing;

an electric motor disposed within said main housing;

a bit mechanically connected to said electric motor, said bit being shaped to fit into a drive socket at the top of the winch; and a self-tailing device mounted on integrally with said main housing, wherein when said electric motor is activated, said bit is rotated to drive the winch.

2. A winch drive as claimed in claim 1, wherein the self-tailing device comprises two annular discs movable apart against a resilient bias to hold a line passed therebetween.

3. A winch drive as claimed in claim 2, wherein the self-tailing device includes a line guide for guiding the line between the discs.

4. A winch drive as claimed in claim 1, further comprising:

a battery housing detachable from said main housing;

a battery disposed inside said battery housing and in electrical communication with said electric motor for powering said electric motor.

5. A winch drive as claimed in claim 4, wherein the power tool has a battery recharging connection terminal.

6. A winch drive as claimed in claim 4, wherein said battery housing comprises a handle attached to said main housing extending substantially radially to the axis of said main housing for holding the winch drive during driving.

7. A winch drive as claimed in claim 1, further comprising:

a handle attached to said main housing extending substantially radially to the axis of said main housing for holding the winch drive during driving.

8. A winch drive as claimed in claim 7, wherein the handle is detachable.

9. A winch drive as claimed in claim 1 further comprising means for reversing the direction of drive of the shaped bit.

10. A winch drive as claimed in claim 1, further comprising at least one of a torque and a speed control for the electric motor.

11. A winch drive as claimed in claim 1, further comprising:

a battery housing integrally formed with said main housing;

a battery disposed inside said battery housing and in electrical communication with said electric motor for powering said electric motor.

12. A winch drive as claimed in claim 1, further comprising:

recesses formed on an outer surface of said main housing in the shape of at least part of a human hand, wherein a user can readily grip and steady the winch drive at said recesses.

* * * * *